US009303302B2

(12) United States Patent
Kaizuka

(10) Patent No.: US 9,303,302 B2
(45) Date of Patent: Apr. 5, 2016

(54) STEEL WITH EXCELLENT ROLLING-CONTACT FATIGUE PROPERTIES

(75) Inventor: Masaki Kaizuka, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 5 days.

(21) Appl. No.: 14/118,370

(22) PCT Filed: May 25, 2011

(86) PCT No.: PCT/JP2011/062000

§ 371 (c)(1),
(2), (4) Date: Nov. 18, 2013

(87) PCT Pub. No.: WO2012/160675

PCT Pub. Date: Nov. 29, 2012

(65) Prior Publication Data

US 2014/0099228 A1 Apr. 10, 2014

(51) Int. Cl.
*C22C 38/60* (2006.01)
*C22C 38/42* (2006.01)
(Continued)

(52) U.S. Cl.
CPC . *C22C 38/60* (2013.01); *C21D 9/40* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/22* (2013.01);
(Continued)

(58) Field of Classification Search
CPC ..... C22C 38/60; C22C 38/50; C22C 38/42; C22C 38/32; C22C 38/28; C22C 38/22
USPC ..... 420/83, 100, 104, 84, 112, 105, 110, 420/101, 87, 90
See application file for complete search history.

(56) References Cited

U.S. PATENT DOCUMENTS 6,224,688 B1 5/2001 Takemura et al.
2003/0136474 A1 7/2003 Matsuzaki et al.
(Continued)

FOREIGN PATENT DOCUMENTS

CN 1460127 A 12/2003
CN 1726295 A 1/2006
(Continued)

OTHER PUBLICATIONS

International Search Report Issued Aug. 30, 2011 in PCT/JP11/06200 Filed May 25, 2011.
(Continued)

*Primary Examiner* — Rebecca Lee
(74) *Attorney, Agent, or Firm* — Oblon, McClelland, Maier & Neustadt, L.L.P.

(57) ABSTRACT

Disclosed is a steel having high manufacturability and better rolling-contact fatigue properties. The steel contains C of 0.65% to 1.30%, Si of 0.05% to 1.00%, Mn of 0.1% to 2.00%, P of greater than 0% to 0.050%, S of greater than 0% to 0.050%, Cr of 0.15% to 2.00%, Al of 0.010% to 0.100%, N of greater than 0% to 0.025%, Ti of greater than 0% to 0.015%, and O of greater than 0% to 0.0025% and further contains iron and unavoidable impurities. Al-containing nitrogen compound particles dispersed in the steel have an average equivalent circle diameter of 25 to 200 nm, and Al-containing nitrogen compound particles each having an equivalent circle diameter of 25 to 200 nm are present in a number density of 1.1 to 6.0 per square micrometer.

9 Claims, 3 Drawing Sheets

(51) Int. Cl.

| | |
|---|---|
| ***C22C 38/32*** | (2006.01) |
| ***C22C 38/28*** | (2006.01) |
| ***C21D 9/40*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/38*** | (2006.01) |
| ***C22C 38/50*** | (2006.01) |
| *C21D 9/30* | (2006.01) |

(52) U.S. Cl.

CPC ..... *C22C 38/24* (2013.01); *C22C 38/26* (2013.01); *C22C 38/28* (2013.01); *C22C 38/32* (2013.01); *C22C 38/38* (2013.01); *C22C 38/42* (2013.01); *C22C 38/50* (2013.01); *C21D 9/30* (2013.01); *C21D 2211/004* (2013.01)

(56) References Cited

U.S. PATENT DOCUMENTS

| | | | | |
|---|---|---|---|---|
| 2008/0240970 | A1 | 10/2008 | Eto et al. | |
| 2009/0274573 | A1* | 11/2009 | Miyanishi et al. | 420/84 |
| 2010/0139811 | A1* | 6/2010 | Kozawa et al. | 148/218 |

FOREIGN PATENT DOCUMENTS

| | | | | |
|---|---|---|---|---|
| CN | 1863935 | A | | 11/2006 |
| JP | 62-294150 | | | 12/1987 |
| JP | 63 135615 | | | 6/1988 |
| JP | 10-30150 | | | 2/1998 |
| JP | 11 80897 | | | 3/1999 |
| JP | 11 256233 | | | 9/1999 |
| JP | 2000-96185 | | | 4/2000 |
| JP | 3 591 236 | | | 9/2004 |
| JP | 2007 131907 | | | 5/2007 |
| JP | 2008-88478 | | | 4/2008 |
| JP | 2008-88482 | | | 4/2008 |
| JP | 2008-274398 | | | 11/2008 |
| JP | 2009242920 | A | * | 10/2009 |
| JP | 4568362 | | | 8/2010 |
| JP | 2011 117009 | | | 6/2011 |
| TW | 200900513 | | | 1/2009 |
| WO | WO 02/059390 | A1 | | 8/2002 |
| WO | WO 2009054530 | A1 | * | 4/2009 |

OTHER PUBLICATIONS

Written Opinion of the International searching Authority Aug. 30. 2011 in PCT/JP11/06200 Filed May 25, 2011.

Supplemental European Search Report issued Mar. 25, 2015 in PCT/JP2011062000.

* cited by examiner

STEEL WITH EXCELLENT ROLLING-CONTACT FATIGUE PROPERTIES

TECHNICAL FIELD

The present invention relates to steels to be adopted to bearing parts and machine structure parts for use typically in automobiles and industrial machinery. Specifically, the present invention relates to steels which exhibit excellent rolling-contact fatigue properties when used as the parts or members.

BACKGROUND ART

Bearings, crankshafts, and other analogous parts are important to support rotating units and sliding units of machinery. These parts are often used in severe environments because they receive a considerably high contact pressure (contact surface pressure) and may receive a varying external force. For this reason, steels to be used as materials for the parts require satisfactory durability.

Such requirement has become more and more exacting with higher and higher performance and smaller and smaller weights of machinery. To improve the durability of shaft or bearing parts, technical improvements in lubricity are important, but improvements in rolling-contact fatigue properties of steels are particularly important.

High-carbon-chromium bearing steels such as SUJ2 prescribed in Japanese Industrial Standard (JIS) G 4805 (1999) have been used as materials for bearings for use in automobiles, industrial machinery, and other various applications. The bearings, however, are disadvantageously susceptible to fatigue fracture caused by very fine defects (e.g., inclusions) because they are used in severe environments typically as inner and outer races and rolling elements of ball bearings and roller bearings where the contact pressure is very high. To solve this disadvantage, attempts have been made to improve bearing steels so as to prolong their rolling-contact fatigue lives themselves to thereby reduce the maintenance frequency.

For example, Patent Literature (PTL) 1 proposes a technique relating to a bearing steel. This technique specifies Ti and Al contents and performs a heating treatment after spheroidizing. This controls the amounts of fine particles of titanium carbide, titanium carbonitride, and aluminum nitride and thereby reduces the size of prior austenitic grains. Thus, the bearing steel may have better rolling-contact fatigue properties.

According to the technique, however, a very high titanium content of 0.26% or more is required, and this disadvantageously increases the steel cost and impairs the steel workability. The resulting steel manufactured by the technique suffers from the formation of coarse titanium nitride particles during casting and may have unevenness in fatigue life due to the formation of precipitates (titanium nitride particles). In addition, the steel has a high aluminum content of 0.11% or more and disadvantageously suffers from cracks and flaws caused by Al-containing nitrogen compounds formed during casting and rolling, thus resulting in poor manufacturability.

CITATION LIST

Patent Literature

PTL 1: Japanese Patent No. 3591236

SUMMARY OF INVENTION

Technical Problem

The present invention has been made under these circumstances, and an object thereof is to provide a steel having satisfactory manufacturability and better rolling-contact fatigue properties.

Solution to Problem

The present invention has achieved the object and provides a steel including: C in a content of from 0.65% to 1.30%; Si in a content of from 0.05% to 1.00%; Mn in a content of from 0.1% to 2.00%; P in a content of from greater than 0% to 0.050%; S in a content of from greater than 0% to 0.050%; Cr in a content of from 0.15% to 2.00%; Al in a content of from 0.010% to 0.100%; N in a content of from greater than 0% to 0.025%; Ti in a content of from greater than 0% to 0.015%; and O in a content of from greater than 0% to 0.0025%, in mass percent, with the balance consisting of iron and inevitable impurities, in which Al-containing nitrogen compound particles dispersed in the steel have an average equivalent circle diameter of from 25 to 200 nm; and Al-containing nitrogen compound particles each having an equivalent circle diameter of from 25 to 200 nm are present in a number density of from 1.1 to 6.0 per square micrometer.

As used herein the term "equivalent circle diameter" refers to a diameter of an assumed circle having the identical area with the particle. In the present invention, there is calculated an equivalent circle diameter of an Al-containing nitrogen compound particle observed in an observation area typically under a transmission electron microscope (TEM) or a scanning electron microscope (SEM). Also as used herein the term "Al-containing nitrogen compound(s)" refers to not only aluminum nitride (AlN), but also corresponding compounds, except for further containing one or more other elements such as Mn, Cr, S, and Si (in a total content of up to about 30%).

In a preferred embodiment, the steel according to the present invention has an average prior austenitic grain size number of 11.5 or less. The steel according to this embodiment can have further better rolling-contact fatigue properties.

The steel according to the present invention may effectively further contain one or more other elements according to necessity. Such other elements are exemplified by:

(a) at least one element selected from the group consisting of Cu in a content of from greater than 0% to 0.25%, Ni in a content of from greater than 0% to 0.25%, and Mo in a content of from greater than 0% to 0.25%;

(b) at least one element selected from the group consisting of Nb in a content of from greater than 0% to 0.5%, V in a content of from greater than 0% to 0.5%, and B in a content of from greater than 0% to 0.005%;

(c) at least one element selected from the group consisting of Ca in a content of from greater than 0% to 0.05%, REM or REMs in a content of from greater than 0% to 0.05%, Mg in a content of from greater than 0% to 0.02%, Li in a content of from greater than 0% to 0.02%, and Zr in a content of from greater than 0% to 0.2%; and (d) at least one element selected from the group consisting of Pb in a content of from greater than 0% to 0.5%, Bi in a content of from greater than 0% to 0.5%, and Te in a content of from greater than 0% to 0.1%. The steel can have further better properties according to the element(s) to be contained.

Advantageous Effects of Invention

The present invention can provide a steel having further better rolling-contact fatigue properties with good manufacturability by controlling its chemical composition and by suitably dispersing Al-containing nitrogen compounds having appropriate sizes in the steel. The steel according to the present invention can exhibit superior rolling-contact fatigue properties even when used in severe environments such as in bearings.

DESCRIPTION OF EMBODIMENTS

Figure 1:
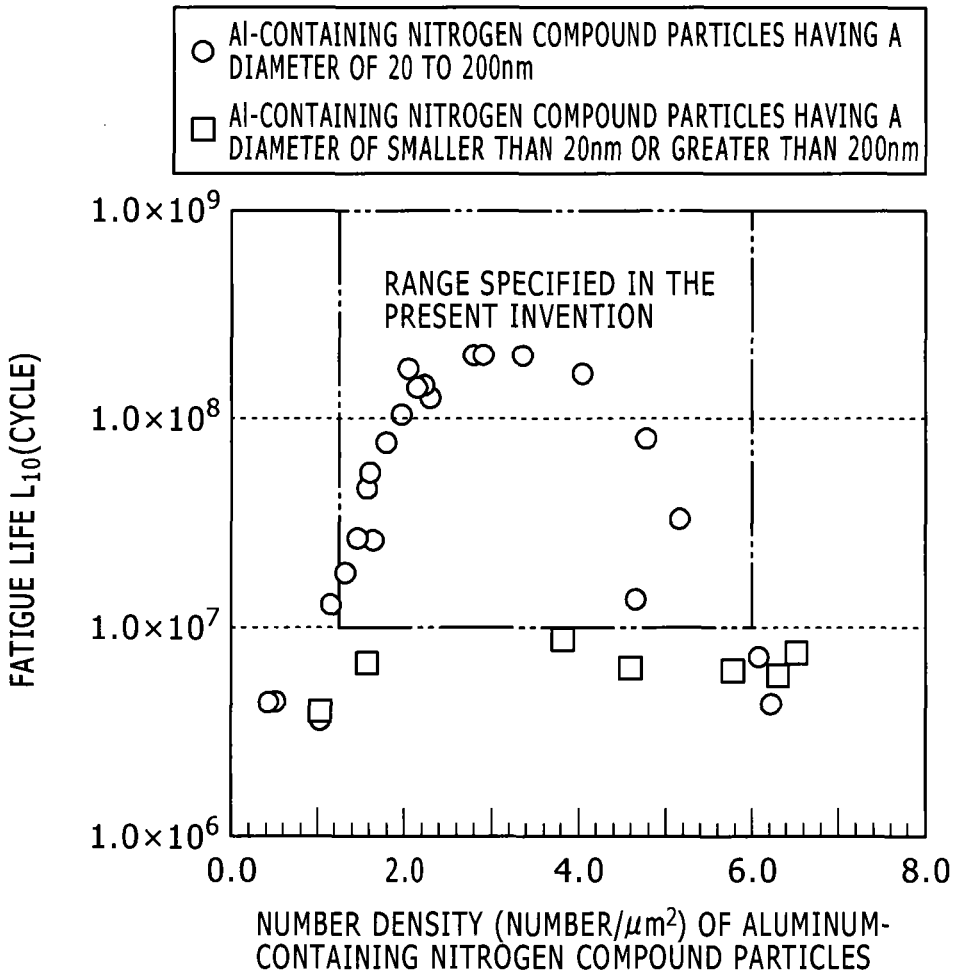
FIG. 1 is a graph illustrating how the fatigue life $L_{10}$ varies depending on the number density of Al-containing nitrogen compound particles.

The present inventors have made various investigations to provide a steel having superior rolling-contact fatigue properties (having a long rolling-contact fatigue life) without impairing its manufacturability. As a result, they have found following findings (A), (B), (C), and (D) to allow the steel to have better rolling-contact fatigue properties.

(A) A satisfactory rolling-contact fatigue life is obtained by reducing the Al content and simultaneously allowing fine Al-containing nitrogen compound particles to disperse in a large amount and to contribute to dispersion strengthening, which dispersion strengthening impedes the generation and propagation of cracks;

(B) to suppress cracking during casting and rolling, the amount (number density) and size of Al-containing nitrogen compound particles should be specified;

(C) to provide a desired degree of dispersion (number density) of fine Al-containing nitrogen compound particles, it is important to strictly control the aluminum and nitrogen contents in the steel, and it is useful to slowly cool the steel in a temperature range of from 850° C. to 650° C., which steel is after hot rolling, and which temperature range is the precipitation temperature range for Al-containing nitrogen compounds, and it is also useful to cool the steel thereafter at a higher cooling rate in a manufacturing process; and (D) the prior austenitic grains, if being excessively fine, may often cause the formation of slack quenching phases and may readily cause the steel to have a short rolling-contact fatigue life.

The present inventors have made further investigations based on the findings to obtain better rolling-contact fatigue properties of a steel. As a result, they have found that the steel can have significantly better rolling-contact fatigue properties by strictly specifying aluminum and nitrogen contents in the steel and by controlling manufacturing conditions thereof so as to allow Al-containing nitrogen compound particles dispersed in the steel after quenching/tempering to have an average equivalent circle diameter of from 25 to 200 nm and to allow Al-containing nitrogen compound particles each having an equivalent circle diameter of from 25 to 200 nm to be present in a number density of from 1.1 to 6.0 per square micrometer. The present invention has been made based on these findings.

An important key in the steel according to the present invention is suitable control of the number density of Al-containing nitrogen compound particles each having an equivalent circle diameter of from 25 to 200 m. Specifically, the dispersion strengthening of Al-containing nitrogen compound particles suppresses the generation and propagation of cracks and contributes to satisfactory rolling-contact fatigue properties. To this end, the size of Al-containing nitrogen compound particles should be suitably controlled. The Al-containing nitrogen compound particles, if having a size (average equivalent circle diameter) of smaller than 25 nm or greater than 200 nm, may fail to exhibit the dispersion strengthening effects. The Al-containing nitrogen compound particles have a size of preferably 40 nm or more (and more preferably 50 nm or more), and preferably 150 nm or less (and more preferably 125 nm or less).

Al-containing nitrogen compound particles each having an equivalent circle diameter of from 25 to 200 m, if present in a number density of less than 1.1 per square micrometer, may fail to exhibit effective dispersion strengthening and fail to contribute to better rolling-contact fatigue properties, resulting in poor rolling-contact fatigue properties. Al-containing nitrogen compound particles each having an equivalent circle diameter of from 25 to 200 m, if present in a number density of more than 6.0 per square micrometer, may cause grains to coarsen to thereby form slack quenching phases (e.g., fine pearlitic and bainitic phases), and this may cause the steel to have a shorter rolling-contact fatigue life (to have inferior rolling-contact fatigue properties). The Al-containing nitrogen compound particles are present in a number density of preferably 1.5 per square micrometer or more (and more preferably 2.0 per square micrometer or more) and preferably 5.0 per square micrometer or less (and more preferably 4.0 per square micrometer or less).

In a preferred embodiment of the steel according to the present invention, prior austenitic grains are effectively controlled. With an increasing grain size number (with a decreasing grain size) of prior austenite grains, the steel may have higher hardness and becomes more resistant to crack propagation. However, with an excessively large grain size number (with an excessively small grain size) of prior austenite grains, the steel may have inferior hardenability, readily include slack quenching phases, and have a shorter rolling-contact fatigue life contrarily. To prevent this, the prior austenitic grains have a grain size number of preferably 11.5 or less, more preferably 11.0 or less, and furthermore preferably 10.5 or less.

The steel according to the present invention is suitably controlled not only in the aluminum and nitrogen contents, but also in other chemical compositions (C, Si, Mn, P, S, Cr, Al, N, Ti, and O). The contents of these chemical compositions are specified for reasons as follows.

C: 0.65% to 1.30%

Carbon (C) element is essential to increase quenched hardness, to maintain strength at room temperature and at elevated temperatures, and to impart wear resistance to the steel. To exhibit these effects, carbon is contained in a content of 0.65% or more and is desirably contained in a content of preferably 0.8% or more and more preferably 0.95% or more. However, carbon, if contained in an excessively high content, may often cause giant carbide particles and adversely affect the rolling-contact fatigue properties contrarily. To prevent this, the carbon content is controlled to 1.30% or less, preferably 1.2% or less, and more preferably 1.1% or less.

Si: 0.05% to 1.00%

Silicon (Si) element usefully allows the matrix to have better solute strengthening and higher hardenability. To exhibit these effects, Si is contained in a content of 0.05% or more and is desirably contained in a content of preferably 0.1% or more and more preferably 0.15% or more. However, Si, if contained in an excessively high content, may cause the steel to have significantly inferior workability and/or machinability. To prevent this, the Si content is controlled to 1.00% or less, preferably 0.9% or less, and more preferably 0.8% or less.

Mn: 0.1% to 2.00%

Manganese (Mn) element is useful for better solute strengthening and hardenability of the matrix. To exhibit these effects, Mn is contained in a content of 0.1% or more and is desirably contained in a content of preferably 0.15% or more and more preferably 0.2% or more. However, Mn, if contained in an excessively high content, may cause the steel to have significantly inferior workability and/or machinability. To prevent this, the Mn content is controlled to 2.00% or less, preferably 1.6% or less, and more preferably 1.2% or less.

P: Greater than 0% to 0.050%

Phosphorus (P) element is contained as an inevitable impurity, but segregates at grain boundaries to impair the workability, and is desirably minimized. Extreme reduction in phosphorus content, however, may invite higher steel-making cost. For these reasons, the phosphorus content is controlled to 0.050% or less, preferably 0.04% or less, and more preferably 0.03% or less.

S: Greater than 0% to 0.050%

Sulfur (S) element is contained as an inevitable impurity, precipitates as MnS (manganese sulfide) to improve the rolling-contact fatigue properties, and is desirably minimized. Extreme reduction in sulfur content, however, may invite higher steel-making cost. For these reasons, the sulfur content is controlled to 0.050% or less, preferably 0.04% or less, and more preferably 0.03% or less.

Cr: 0.15% to 2.00%

Chromium (Cr) combines with carbon to form a carbide, thereby imparts wear resistance to the steel, and contributes to better hardenability of the steel. To exhibit such effects, Cr is contained in a content of 0.15% or more, and is desirably contained in a content of preferably 0.5% or more, and more preferably 0.9% or more. However, Cr, if contained in an excessively high content, may form coarse carbide particles and cause the steel to have a shorter rolling-contact fatigue life contrarily. To prevent this, the Cr content is controlled to 2.00% or less, preferably 1.8% or less, and more preferably 1.6% or less.

Al: 0.010% to 0.100%

Aluminum (Al) element plays an important role in the steel according to the present invention, combines with nitrogen, is thereby finely dispersed as Al-containing nitrogen compound particles in the steel, and helps the steel to have better rolling-contact fatigue properties. To form fine Al-containing nitrogen compound particles, Al should be contained in a content of at least 0.010% or more. However, Al, if contained in an excessively high content of greater than 0.100%, may cause Al-containing nitrogen compound particles to precipitate in a larger size and in a larger number (number density), and this may cause the steel to be susceptible to cracks or flaws during casting and rolling. In addition, Al in such an excessively high content may cause grains to be excessively fine and thereby impair the hardenability. The resulting steel may be inapplicable to large-sized parts and have a shorter rolling-contact fatigue life. The Al content is preferably 0.013% or more and more preferably 0.015% or more in terms of its lower limit, and is preferably 0.08% or less and more preferably 0.05% or less in terms of its upper limit.

N: Greater than 0% to 0.025%

Nitrogen (N) element plays an important role in the steel according to the present invention as with Al, forms finely dispersed Al-containing nitrogen compound particles, and thereby significantly helps the steel to exhibit better rolling-contact fatigue properties effectively. However, nitrogen, if contained in an excessively high content of greater than 0.025%, may cause Al-containing nitrogen compound particles to precipitate in a larger size and in a larger number density, and this may cause the steel to be susceptible to cracks or flaws during casting and rolling. Nitrogen in such an excessively high content may cause grains to be excessively fine and thereby impair the hardenability. The resulting steel is inapplicable to large-sized parts and has a shorter rolling-contact fatigue life. A lower limit of the nitrogen content is not critical, as long as Al-containing nitrogen compound particles can precipitate in a predetermined amount. The lower limit can be suitably set according to the post-rolling cooling rate, the contents of elements to be combined with nitrogen (e.g., Ti, V, Nb, B, Zr, and Te), and the Al content. Typically, Al-containing nitrogen compounds can precipitate in a predetermined amount at a nitrogen content of 0.0035% or more. The nitrogen content is preferably 0.004% or more and more preferably 0.006% or more in terms of its lower limit, and is preferably 0.020% or less and more preferably 0.022% or less in terms of its upper limit.

Ti: Greater than 0% to 0.015%

Titanium (Ti) element combines with nitrogen in the steel to form TiN (titanium nitride) and adversely affects the rolling-contact fatigue properties. In addition, Ti harmfully adversely affect the cold workability and hot workability and is desirably minimized. Extreme reduction in Ti content, however, may invite higher steel-making cost. For these reasons, the Ti content is controlled to 0.015% or less. The Ti content is preferably 0.01% or less and more preferably 0.005% or less in terms of its upper limit.

O: Greater than 0% to 0.0025%

Oxygen (O) element significantly affects the shapes of impurities in the steel, forms $Al_2O_3$, $SiO_2$, and other inclusions adversely affecting the rolling-contact fatigue properties, and is desirably minimized. Extreme reduction in oxygen content, however, may invite higher steel-making cost. For these reasons, the oxygen content is controlled to 0.0025% or less. The oxygen content is preferably 0.002% or less and more preferably 0.0015% or less in terms of its upper limit.

Elements to be contained and specified in the present invention are as above with the balance being iron and inevitable impurities. Elements contained in raw materials, construction materials, and manufacturing facilities may be brought into the steel as the inevitable impurities. To further prolong the rolling-contact fatigue life, the steel can positively further contain one or more elements as follows:

At least one element selected from the group consisting of Cu: greater than 0% to 0.25%, Ni: greater than 0% to 0.25%. and Mo: greater than 0% to 0.25%

Copper (Cu), nickel (Ni), and molybdenum (Mo) elements each improve the matrix hardenability, increase the hardness, and contribute to better rolling-contact fatigue properties of the steel. The elements can effectively exhibit such effects when contained each in a content of 0.03% or more. However, the elements, if contained each in a content of greater than 0.25%, may adversely affect the workability.

At least one element selected from the group consisting of Nb: greater than 0% to 0.5%, V: greater than 0% to 0.5%, and B: greater than 0% to 0.005%

Niobium (Nb), vanadium (V), and boron (B) elements each combine with nitrogen to form nitrogen compounds, and effectively grade the grains to improve the rolling-contact fatigue properties. Nb and B, when added each in a content of 0.0005% or more, and V, when added in a content of 0.001% or more, can contribute to better rolling-contact fatigue properties. However, Nb and V, if contained each in a content of greater than 0.5%, and B, if contained in a content of greater than 0.005%, may cause grains to be excessively fine and often cause the formation of slack quenching phases. The Nb and V contents are more preferably 0.3% or less and furthermore preferably 0.1% or less; whereas the boron content is more preferably 0.003% or less and furthermore preferably 0.001% or less, in terms of their upper limits.

At least one element selected from the group consisting of Ca: greater than 0% to 0.05%, REM or REMs: greater than 0% to 0.05%, Mg: greater than 0% to 0.02%, Li: greater than 0% to 0.02%, and Zr: greater than 0% to 0.2%

Calcium (Ca), rare-earth elements (REMs), magnesium (Mg), lithium (Li), and zirconium (Zr) elements each spheroidize oxide inclusions and thereby contribute to better rolling-contact fatigue properties. Such effects can be effectively exhibited at a Ca or REM content of 0.0005% or more, or at a Mg, Li, or Zr content of 0.0001% or more. The effects, however, may be saturated at an excessively high content of these elements, and effects corresponding to the content are not expected, resulting in poor economical efficiency. To prevent this, the elements are used in contents within the above-specified ranges, respectively. The Ca and REM contents are each more preferably 0.03% or less and furthermore preferably 0.01% or less; the Mg and Li contents are each more preferably 0.01% or less and furthermore preferably 0.005% or less; and the Zr content is more preferably 0.15% or less and furthermore preferably 0.10% or less, in terms of their upper limits.

At least one element selected from the group consisting of Pb: greater than 0% to 0.5%, Bi: greater than 0% to 0.5%, and Te: greater than 0% to 0.1%

Lead (Pb), bismuth (Bi), and tellurium (Te) elements each contribute to better machinability. Such effects can be effectively exhibited at a Pb or Bi content of 0.01% or more, or at a Te content of 0.0001% or more. However, Pb or Bi in a content of greater than 0.5%, or Te in a content of greater than 0.1% may disadvantageously cause, for example, roll marks upon manufacturing. The Pb and Bi contents are each more preferably 0.3% or less and furthermore preferably 0.2% or less; whereas the Te content is more preferably 0.075% or less and furthermore preferably 0.05% or less, in terms of their upper limits.

To disperse fine Al-containing nitrogen compound particles in the steel according to the present invention after quenching/tempering, it is important to use slabs having a chemical composition satisfying the above conditions and to control the cooling rate after rolling in the steel manufacturing process. Al-containing nitrogen compound particles precipitated in the post-rolling cooling process remain as intact even after subsequent spheroidizing, parts fabricating, and quenching/tempering processes. In the present invention, Al-containing nitrogen compound particles are controlled to have an average equivalent circle diameter of from 25 to 200 nm, and Al-containing nitrogen compound particles each having an equivalent circle diameter of from 25 to 200 nm are controlled to be dispersed in a number density of from 1.1 to 6.0 per square micrometer. To achieve this, an average cooling rate of the steel in a temperature range of from 850° C. to 650° C. is controlled to fall within a range of from 0.10° C. to 0.90° C. per second. The average cooling rate in this temperature range is also referred to as "average primary cooling rate". The temperature range is a temperature range within which Al-containing nitrogen compound particles precipitate. In addition, an average cooling rate in a temperature range of from 650° C. to room temperature (25° C.) is controlled to 1° C. or more per second. This cooling rate is also referred to as "secondary cooling rate". The average equivalent circle diameter of Al-containing nitrogen compound particles precipitated through the post-rolling cooling process, and the number per unit area (number density) of Al-containing nitrogen compound particles each having an equivalent circle diameter of from 25 to 200 nm are maintained as intact even after the subsequent spheroidizing, parts fabricating, and quenching/tempering processes, regardless of process conditions in these processes.

Cooling performed at a primary cooling rate of less than 0.10° C. per second may cause Al-containing nitrogen compound particles to coarsen. In contrast, cooling at a primary cooling rate of more than 0.90° C. per second may cause the Al-containing nitrogen compound particles to have an average equivalent circle diameter of less than 25 nm, or cause Al-containing nitrogen compound particles each having the predetermined size to be present in a number density of less than 1.1 per square micrometer. Thus, the Al-containing nitrogen compound particles may fail to have a desired size and to be present in a desired number density. In contrast, cooling, when performed at a secondary cooling rate of 1° C. per or more, can suppress coarsening of Al-containing nitrogen compound particles and control the size thereof.

The steel according to the present invention is formed into a predetermined part shape, then quenched/tempered, and yields, for example, a bearing part. The steel as a material can have any shape such as a wire, rod, or any other shape, as long as being applicable to the manufacturing. The steel size is also suitably determined according to the final product.

The present invention will be illustrated in further detail with reference to several examples below. It should be noted, however, that these examples are never intended to limit the scope of the invention; various changes and modifications may be made without departing from the scope and spirit of the invention and all fall within the scope of the invention.

EXAMPLES

Steels (Tests Nos. 1 to 51) having chemical compositions given in Tables 1 and 2 below were each heated to a temperature of from 1100° C. to 1300° C. in a heating furnace or soaking furnace and subjected to blooming at a temperature of from 900° C. to 1200° C. The steels after blooming were heated to a temperature of from 900° C. to 1100° C., subjected to rolling (including forging that simulates rolling), and yielded round bars having a diameter of 70 mm. After the completion of rolling, the round bars were cooled from 850° C. down to 650° C. at different average cooling rates (as given in Tables 3 and 4), and further cooled from 650° C. down to room temperature (25° C.) at an average cooling rate of 1° C. per second, and yielded rolled steels or forged steels.

The rolled steels or forged steels were subjected to spheroidizing at 795° C. for a holding time of 6 hours and subjected to surface shaving by cutting. Circular plates of 60 mm in diameter by 5 mm in thickness were cut out from the resulting rolled steels or forged steels, heated at 840° C. for 30 minutes, subsequently subjected to oil quenching and to tempering at 160° C. for 120 minutes. The works were finally subjected to final polishing and yielded specimens having a surface roughness Ra (arithmetic mean surface roughness) of 0.04 μm or less.

TABLE 1

| Test number | Chemical composition (in mass percent)* C | Si | Mn | P | S | Cr | Al | Ti | N | O | Other elements |
|---|---|---|---|---|---|---|---|---|---|---|---|
| 1 | 0.98 | 0.25 | 0.29 | 0.011 | 0.002 | 1.57 | 0.031 | 0.0009 | 0.011 | 0.0006 | — |
| 2 | 0.97 | 0.24 | 0.34 | 0.013 | 0.005 | 1.43 | 0.022 | 0.0015 | 0.0043 | 0.0005 | — |
| 3 | 0.96 | 0.24 | 0.33 | 0.013 | 0.004 | 1.45 | 0.023 | 0.0015 | 0.0102 | 0.0008 | — |
| 4 | 0.98 | 0.23 | 0.35 | 0.012 | 0.003 | 1.46 | 0.033 | 0.0021 | 0.0182 | 0.0008 | — |
| 5 | 0.97 | 0.24 | 0.35 | 0.012 | 0.002 | 1.45 | 0.019 | 0.0018 | 0.018 | 0.0008 | — |
| 6 | 0.99 | 0.33 | 0.31 | 0.012 | 0.003 | 1.41 | 0.029 | 0.0010 | 0.0165 | 0.0007 | — |
| 7 | 1.06 | 0.25 | 0.34 | 0.013 | 0.005 | 1.48 | 0.015 | 0.0025 | 0.0074 | 0.0010 | — |
| 8 | 0.99 | 0.34 | 0.29 | 0.012 | 0.001 | 1.49 | 0.027 | 0.0021 | 0.0098 | 0.0006 | — |
| 9 | 1.00 | 0.25 | 0.33 | 0.011 | 0.002 | 1.45 | 0.023 | 0.0006 | 0.0043 | 0.0006 | — |
| 10 | 1.01 | 0.25 | 0.39 | 0.011 | 0.003 | 1.45 | 0.019 | 0.0006 | 0.0075 | 0.0006 | — |
| 11 | 1.03 | 0.28 | 0.35 | 0.016 | 0.007 | 0.94 | 0.042 | 0.0014 | 0.0108 | 0.0011 | — |
| 12 | 1.02 | 0.29 | 0.34 | 0.015 | 0.001 | 1.53 | 0.057 | 0.0009 | 0.0198 | 0.0009 | — |
| 13 | 1.02 | 0.24 | 0.74 | 0.068 | 0.003 | 1.46 | 0.061 | 0.0010 | 0.0174 | 0.0007 | — |
| 14 | 0.99 | 0.33 | 0.31 | 0.012 | 0.003 | 1.41 | 0.036 | 0.0010 | 0.0175 | 0.0007 | — |
| 15 | 0.93 | 0.46 | 0.33 | 0.013 | 0.002 | 1.45 | 0.029 | 0.0015 | 0.0165 | 0.0007 | — |
| 16 | 0.98 | 0.23 | 0.35 | 0.012 | 0.003 | 1.46 | 0.035 | 0.0016 | 0.0164 | 0.0013 | B: 0.0021 |
| 17 | 0.99 | 0.35 | 0.29 | 0.025 | 0.008 | 1.57 | 0.034 | 0.0012 | 0.0121 | 0.0009 | Ni: 0.20, Cu: 0.24 |
| 18 | 1.24 | 0.32 | 0.54 | 0.021 | 0.023 | 1.63 | 0.022 | 0.0035 | 0.0069 | 0.0012 | Mo: 0.06 |
| 19 | 0.89 | 0.86 | 0.85 | 0.036 | 0.025 | 1.13 | 0.042 | 0.0024 | 0.0135 | 0.0008 | REM: 0.001 |
| 20 | 0.93 | 0.46 | 0.26 | 0.025 | 0.014 | 1.12 | 0.038 | 0.0027 | 0.0112 | 0.0008 | Ca: 0.002, Mg: 0.0002 |
| 21 | 0.87 | 0.41 | 1.24 | 0.043 | 0.018 | 1.27 | 0.038 | 0.0013 | 0.0109 | 0.0013 | Li: 0.0003, Zr: 0.0002 |
| 22 | 1.02 | 0.24 | 0.74 | 0.018 | 0.012 | 1.34 | 0.038 | 0.0012 | 0.0096 | 0.0009 | Pb: 0.05 |
| 23 | 1.02 | 0.36 | 0.83 | 0.002 | 0.003 | 1.42 | 0.072 | 0.0010 | 0.0108 | 0.0006 | — |
| 24 | 0.98 | 0.53 | 0.28 | 0.017 | 0.006 | 1.63 | 0.026 | 0.0008 | 0.0137 | 0.0008 | — |
| 25 | 1.11 | 0.28 | 0.64 | 0.016 | 0.014 | 1.23 | 0.042 | 0.0020 | 0.0157 | 0.0014 | — |
| 26 | 0.98 | 0.53 | 0.31 | 0.015 | 0.017 | 1.63 | 0.061 | 0.0013 | 0.0158 | 0.0010 | — |

*Remainder: iron and inevitable impurities other than P, S, and O

TABLE 2

| Test number | Chemical composition (in mass percent)* C | Si | Mn | P | S | Cr | Al | Ti | N | O | Other elements |
|---|---|---|---|---|---|---|---|---|---|---|---|
| 27 | 0.98 | 0.23 | 1.28 | 0.011 | 0.002 | 0.94 | 0.062 | 0.0016 | 0.0142 | 0.0013 | — |
| 28 | 1.21 | 0.85 | 0.69 | 0.025 | 0.006 | 1.53 | 0.052 | 0.0015 | 0.0176 | 0.0007 | Bi: 0.07 |
| 29 | 1.05 | 0.28 | 0.37 | 0.026 | 0.009 | 1.47 | 0.072 | 0.0016 | 0.0198 | 0.0013 | Nb: 0.0010 |
| 30 | 1.02 | 0.36 | 0.34 | 0.015 | 0.006 | 1.44 | 0.092 | 0.0013 | 0.0168 | 0.0010 | V: 0.0031 |
| 31 | 1.03 | 0.33 | 0.39 | 0.012 | 0.003 | 1.56 | 0.023 | 0.0005 | 0.0038 | 0.0006 | Te: 0.02 |
| 32 | 0.99 | 0.34 | 0.33 | 0.012 | 0.002 | 1.47 | 0.021 | 0.0007 | 0.0039 | 0.0005 | — |
| 33 | 1.02 | 0.36 | 0.64 | 0.002 | 0.003 | 1.34 | 0.114 | 0.0013 | 0.0085 | 0.0013 | — |
| 34 | 0.85 | 0.27 | 1.51 | 0.014 | 0.005 | 1.15 | 0.281 | 0.0009 | 0.0078 | 0.0010 | — |
| 35 | 1.01 | 0.25 | 0.39 | 0.013 | 0.005 | 1.48 | 0.067 | 0.0025 | 0.0235 | 0.0009 | — |
| 36 | 0.97 | 0.72 | 0.28 | 0.037 | 0.003 | 1.23 | 0.009 | 0.0020 | 0.0201 | 0.0014 | — |
| 37 | 1.13 | 0.79 | 0.69 | 0.026 | 0.022 | 2.17 | 0.102 | 0.0102 | 0.0161 | 0.0015 | — |
| 38 | 0.98 | 0.36 | 1.92 | 0.011 | 0.002 | 1.40 | 0.082 | 0.0009 | 0.0205 | 0.0006 | — |
| 39 | 0.97 | 0.53 | 0.29 | 0.001 | 0.018 | 1.39 | 0.024 | 0.0008 | 0.0070 | 0.0026 | — |
| 40 | 0.98 | 0.24 | 0.33 | 0.013 | 0.005 | 1.44 | 0.019 | 0.0160 | 0.0040 | 0.0007 | — |
| 41 | 1.06 | 0.34 | 0.57 | 0.013 | 0.004 | 1.42 | 0.022 | 0.0011 | 0.0272 | 0.0008 | — |
| 42 | 1.11 | 0.60 | 0.53 | 0.002 | 0.017 | 1.63 | 0.064 | 0.016 | 0.0122 | 0.0012 | — |
| 43 | 1.04 | 0.38 | 0.83 | 0.017 | 0.008 | 0.13 | 0.024 | 0.0015 | 0.0077 | 0.0012 | — |
| 44 | 1.08 | 0.48 | 0.32 | 0.054 | 0.004 | 0.76 | 0.026 | 0.0011 | 0.0147 | 0.0008 | — |
| 45 | 1.34 | 0.36 | 0.34 | 0.016 | 0.002 | 0.94 | 0.020 | 0.0013 | 0.0014 | 0.0013 | — |
| 46 | 1.01 | 0.35 | 0.33 | 0.014 | 0.052 | 1.43 | 0.027 | 0.0012 | 0.0074 | 0.0009 | — |
| 47 | 0.97 | 0.04 | 0.29 | 0.001 | 0.001 | 1.39 | 0.020 | 0.0008 | 0.007 | 0.0005 | — |
| 48 | 0.63 | 0.28 | 2.02 | 0.016 | 0.002 | 1.41 | 0.020 | 0.0013 | 0.0076 | 0.0006 | — |
| 49 | 1.13 | 1.04 | 1.38 | 0.023 | 0.018 | 1.77 | 0.019 | 0.0083 | 0.0085 | 0.0011 | — |
| 50 | 1.13 | 0.72 | 0.08 | 0.024 | 0.021 | 1.94 | 0.074 | 0.0087 | 0.0146 | 0.0014 | — |
| 51 | 1.05 | 0.39 | 0.37 | 0.018 | 0.009 | 2.02 | 0.043 | 0.0016 | 0.0078 | 0.0013 | — |

*Remainder: iron and inevitable impurities other than P, S, and O

The above-prepared specimens were subjected to measurements for the number (number density) and size of Al-containing nitrogen compound particles and grains (grain size number) of prior austenite and to evaluations for fatigue life and cracking (the presence or absence of cracks).

Measurement for Number Density and Size of Al-Containing Nitrogen Compound Particles How the Al-containing nitrogen compound particles were dispersed was determined in the following manner. Each of the specimens after the heat treatment was cut, a cross section of which was polished, the polished cross section was subjected to carbon vapor deposition to give a replica, and the replica was observed with a field-emission transmission electron microscope (FE-TEM). In this process, the chemical composition of Al-containing nitrogen compounds containing aluminum and nitrogen was determined with an energy-dispersive X-ray detector of the TEM, and fields of view thereof were observed at a 30000-fold magnification. One field of view was set to have an area of 16.8 $\mu m^2$. Arbitrary three fields of view were observed at a total area of 50.4 $\mu m^2$, and the data were analyzed with a particle analysis software ["Particle Analysis III for Windows. Version 3.00 SUMITOMO METAL TECHNOLOGY" (trade name)] to determine the size (average equivalent circle diameter) of the particles, and the number of Al-containing nitrogen compound particles each having an equivalent circle diameter of from 25 to 200 nm. The number was converted into a value per square micrometer and defined as a number density.

Prior Austenitic Grain (Grain Size Number) Measurement

Each of the specimens after the heat treatment was cut, a cross section of which was polished, the polished cross section was etched to reveal prior austenitic grain boundaries, images were taken at four points at a depth of 150 μm from the surface layer, and the prior austenitic grain size (grain size number) was measured according to JIS G 0551 by the method of comparing with standard grain size charts.

Fatigue Life Measurement

Each of the steels (specimens) was subjected to a rolling-contact fatigue test 16 times using a thrust-type rolling-contact fatigue test rig at a cycle rate of 1500 rpm, a contact pressure of 5.3 GPa, and a number of interruptions of $2\times10^8$. A fatigue life $L_{10}$ was determined by plotting an accumulated failure probability on a Weibull probability paper and defining, as the fatigue life $L_{10}$, a number of stress cycles until the sample underwent fatigue fracture at an accumulated failure probability of 10%. The resulting fatigue life $L_{10}$ was evaluated. A sample steel having a fatigue life $L_{10}$ ($L_{10}$ life) of $1.0\times10^7$ or more was acceptable herein.

Cracking Evaluation

The surface of each of the samples after rolling and those after forging was cut, and the exposed surface of which was visually observed. A sample suffering from a flaw (crack) of 3 mm or longer was determined as having cracking.

These data are also indicated together with manufacturing conditions (the primary cooling rate and the presence/absence of secondary cooling) in Tables 3 and 4 as follows.

TABLE 3

| Test number | Number density (number/$\mu m^2$) of Al-containing nitrogen compound particles | Size (nm) of Al-containing nitrogen compound particles | Average post-rolling cooling rate (° C./sec) from 850° C. to 650° C. | Presence/absence of secondary cooling | Grain size number | Presence/absence of cracking | $L_{10}$ life (cycle) |
|---|---|---|---|---|---|---|---|
| 1 | 6.3 | 216.0 | 0.16 | Absence | 12.6 | Absence | $5.9\times10^6$ |
| 2 | 0.6 | 84.0 | 1.24 | Presence | 9.0 | Absence | $4.3\times10^6$ |
| 3 | 1.7 | 52.0 | 0.33 | Presence | 10.0 | Absence | $2.4\times10^7$ |
| 4 | 2.3 | 112.0 | 0.20 | Presence | 10.3 | Absence | $1.2\times10^8$ |
| 5 | 1.5 | 64.0 | 0.41 | Presence | 9.5 | Absence | $2.5\times10^7$ |
| 6 | 4.6 | 228.0 | 0.24 | Absence | 11.0 | Absence | $6.2\times10^6$ |
| 7 | 1.0 | 29.0 | 0.95 | Presence | 9.0 | Absence | $3.5\times10^6$ |
| 8 | 1.6 | 78.0 | 0.35 | Presence | 9.0 | Absence | $4.4\times10^7$ |
| 9 | 0.5 | 45.0 | 1.54 | Presence | 9.1 | Absence | $4.3\times10^6$ |
| 10 | 2.1 | 98.0 | 0.12 | Presence | 10.4 | Absence | $1.7\times10^8$ |
| 11 | 4.8 | 176.0 | 0.15 | Presence | 11.2 | Absence | $8.2\times10^7$ |
| 12 | 6.2 | 198.0 | 0.03 | Presence | 12.8 | Absence | $4.2\times10^6$ |
| 13 | 6.1 | 194.0 | 0.06 | Presence | 11.7 | Absence | $7.2\times10^6$ |
| 14 | 5.2 | 182.0 | 0.12 | Presence | 11.4 | Absence | $3.2\times10^7$ |
| 15 | 3.8 | 224.0 | 0.32 | Absence | 10.6 | Absence | $8.4\times10^6$ |
| 16 | 3.4 | 106.0 | 0.18 | Presence | 10.5 | Absence | $2.0\times10^8$ |
| 17 | 2.8 | 122.0 | 0.10 | Presence | 10.0 | Absence | $2.0\times10^8$ |
| 18 | 1.2 | 60.3 | 0.40 | Presence | 9.0 | Absence | $1.2\times10^7$ |
| 19 | 2.9 | 94.0 | 0.58 | Presence | 10.2 | Absence | $1.9\times10^8$ |
| 20 | 2.3 | 76.8 | 0.62 | Presence | 9.7 | Absence | $1.4\times10^8$ |
| 21 | 1.6 | 47.0 | 0.84 | Presence | 9.3 | Absence | $5.3\times10^7$ |
| 22 | 2.0 | 71.4 | 0.64 | Presence | 9.5 | Absence | $1.0\times10^8$ |
| 23 | 6.5 | 238.6 | 0.06 | Absence | 12.4 | Absence | $7.3\times10^6$ |
| 24 | 1.1 | 18.8 | 0.92 | Presence | 9.0 | Absence | $3.9\times10^6$ |
| 25 | 1.6 | 15.2 | 1.20 | Presence | 9.4 | Absence | $6.6\times10^6$ |
| 26 | 5.8 | 202.8 | 0.08 | Presence | 11.9 | Absence | $6.3\times10^6$ |

TABLE 4

| Test number | Number density (number/μm$^2$) of Al-containing nitrogen compound particles | Size (nm) of Al-containing nitrogen compound particles | Average post-rolling cooling rate (° C./sec) from 850° C. to 650° C. | Presence/ absence of secondary cooling | Grain size number | Presence/ absence of cracking | $L_{10}$ life (cycle) |
|---|---|---|---|---|---|---|---|
| 27 | 4.1 | 82.0 | 0.26 | Presence | 11.0 | Absence | $1.6 \times 10^8$ |
| 28 | 1.8 | 163.7 | 0.26 | Presence | 10.3 | Absence | $7.5 \times 10^7$ |
| 29 | 2.2 | 131.1 | 0.46 | Presence | 9.6 | Absence | $1.3 \times 10^8$ |
| 30 | 5.8 | 78.0 | 0.14 | Presence | 11.4 | Absence | $1.8 \times 10^7$ |
| 31 | 1.6 | 102.0 | 0.11 | Presence | 9.3 | Absence | $5.3 \times 10^7$ |
| 32 | 1.3 | 88.8 | 0.18 | Presence | 9.1 | Absence | $1.7 \times 10^7$ |
| 33 | 8.0 | 292.2 | 0.12 | Absence | 13.8 | Presence | $6.9 \times 10^6$ |
| 34 | 18.5 | 628.2 | 0.12 | Presence | 14.2 | Presence | $5.9 \times 10^6$ |
| 35 | 7.1 | 222.5 | 0.12 | Presence | 10.5 | Presence | $1.4 \times 10^7$ |
| 36 | 1.3 | 14.5 | 0.76 | Presence | 9.2 | Absence | $8.5 \times 10^6$ |
| 37 | 7.7 | 251.4 | 0.34 | Presence | 13.2 | Absence | $4.5 \times 10^6$ |
| 38 | 7.6 | 243.7 | 0.15 | Presence | 13.1 | Absence | $6.8 \times 10^6$ |
| 39 | 1.2 | 61.4 | 0.47 | Presence | 9.0 | Absence | $2.2 \times 10^6$ |
| 40 | 0.6 | 54.0 | 0.50 | Presence | 8.6 | Absence | $4.7 \times 10^6$ |
| 41 | 4.5 | 121.8 | 0.24 | Presence | 11.2 | Absence | $7.9 \times 10^6$ |
| 42 | 4.0 | 128.3 | 0.64 | Presence | 10.8 | Absence | $8.9 \times 10^6$ |
| 43 | 1.6 | 75.9 | 0.37 | Presence | 9.2 | Absence | $7.5 \times 10^6$ |
| 44 | 2.9 | 103.7 | 0.28 | Presence | 10.1 | Absence | $7.0 \times 10^6$ |
| 45 | 0.6 | 68.0 | 0.29 | Presence | 8.6 | Absence | $6.5 \times 10^6$ |
| 46 | 1.7 | 80.2 | 0.38 | Presence | 9.3 | Absence | $4.9 \times 10^6$ |
| 47 | 1.7 | 38.7 | 0.58 | Presence | 8.7 | Absence | $7.2 \times 10^6$ |
| 48 | 1.4 | 71.7 | 0.34 | Presence | 9.1 | Absence | $7.7 \times 10^6$ |
| 49 | 1.3 | 12.6 | 0.78 | Presence | 8.5 | Absence | $7.7 \times 10^6$ |
| 50 | 4.4 | 123.2 | 0.86 | Presence | 11.1 | Absence | $5.7 \times 10^6$ |
| 51 | 2.1 | 78.5 | 0.64 | Presence | 9.6 | Absence | $7.7 \times 10^6$ |

The data indicate as follows. Specifically, the data demonstrate that the samples of Tests Nos. 3 to 5, 8, 10, 11, 14, 16 to 22, and 27 to 32 satisfied conditions (chemical composition, size and number density of Al-containing nitrogen compound particles) specified in the present invention, or further satisfied a preferred condition (prior austenitic grain size number); and that these samples each had excellent rolling-contact fatigue properties without suffering from cracks.

In contrast, the samples of Tests Nos. 1, 2, 6, 7, 9, 12, 13, 15, 23 to 26, and 33 to 51 did not satisfy one or more of the conditions specified in the present invention and had short rolling-contact fatigue lives.

Specifically, the samples of Tests Nos. 1, 6, 15, 23, 26, 33, 35, 37, and 38 underwent post-rolling cooling under unsuitable conditions, suffered from excessively large sizes of Al-containing nitrogen compound particles, and had short rolling-contact fatigue lives. Of these samples, the samples of Tests Nos. 23, 26, 33, 37, and 38 also had a prior austenitic grain size number out of the preferred range specified in the present invention.

The samples of Tests Nos. 2, 7, 9, 24, and 25 underwent post-rolling cooing at an excessively high cooling rate; whereas the sample of Test No. 40 suffered from titanium nitride (TiN) formation due to an excessively high Ti content. These samples contained Al-containing nitrogen compound particles in insufficient number densities. The sample of Test No. 34 contained Al in a content greater than the range specified in the present invention and thereby included Al-containing nitrogen compounds in an excessively high number density and in an excessively large size. These samples had short rolling-contact fatigue lives.

The samples of Tests Nos. 12 and 13 included Al-containing nitrogen compound particles in an excessively high number density and had a prior austenitic grain size number out of the preferred range specified in the present invention. These samples had short rolling-contact fatigue lives.

The samples of Tests Nos. 36 to 39, and 41 to 51 each had a chemical composition out of the range specified in the present invention, of which the samples of Tests Nos. 37 and 38 also did not satisfy the other conditions as specified above. These samples had short rolling-contact fatigue lives.

Figure 2:
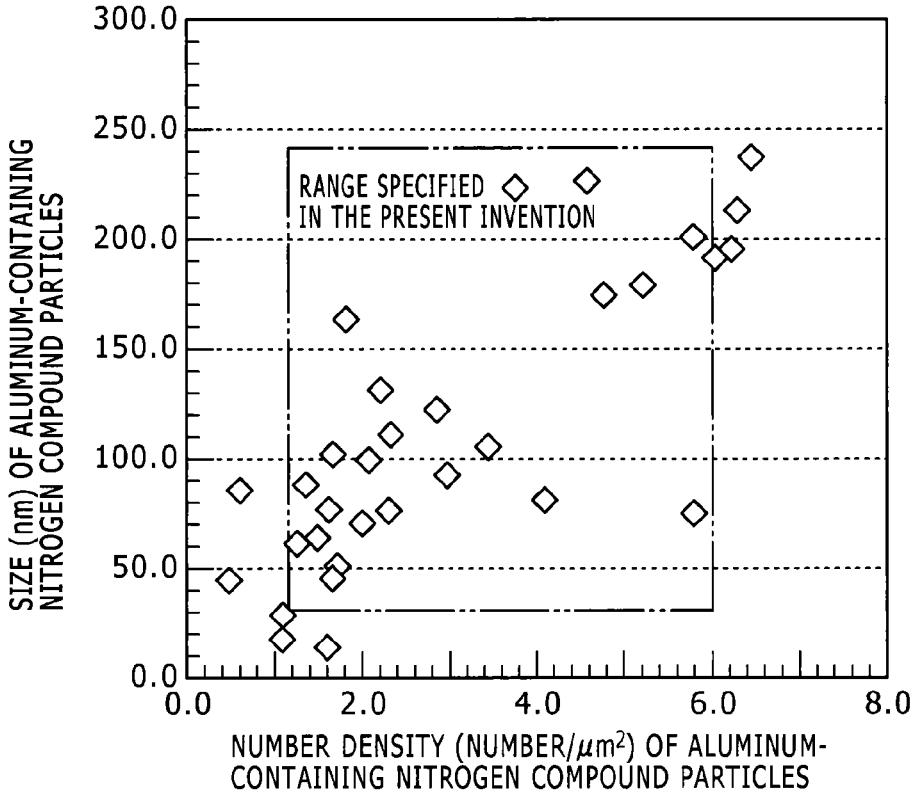
FIG. 2 is a graph illustrating how the size varies depending on the number density, each of the Al-containing nitrogen compound particles.

Based on the data FIG. 1 illustrates how the fatigue life $L_{10}$ varies depending on the number density of Al-containing nitrogen compound particles (Al-containing nitrogen compound particles each having an equivalent circle diameter of from 25 to 200); and FIG. 2 illustrates how the size (average equivalent circle diameter) varies depending on the number density, each of Al-containing nitrogen compound particles. In these figures, there are plotted data of samples having chemical compositions satisfying the conditions specified in the present invention. These figures demonstrate that steels can each have a long fatigue life $L_{10}$ (rolling-contact fatigue life) by controlling the number density and size of Al-containing nitrogen compound particles.

Figure 3:
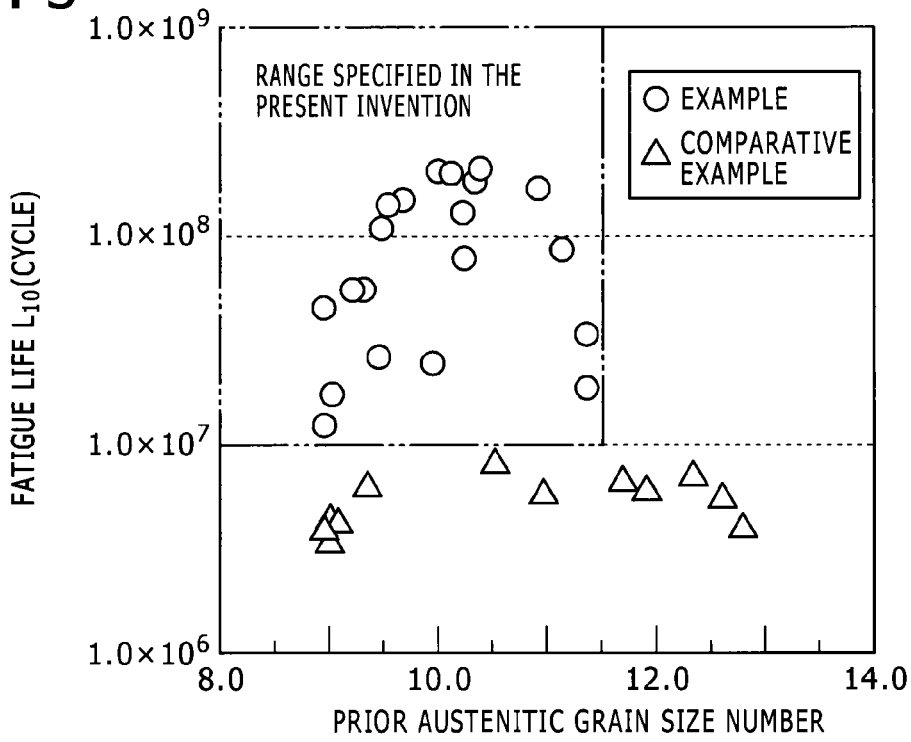
FIG. 3 is a graph illustrating how the fatigue life $L_{10}$ varies depending on the prior austenitic grain size number.
Figure 4:
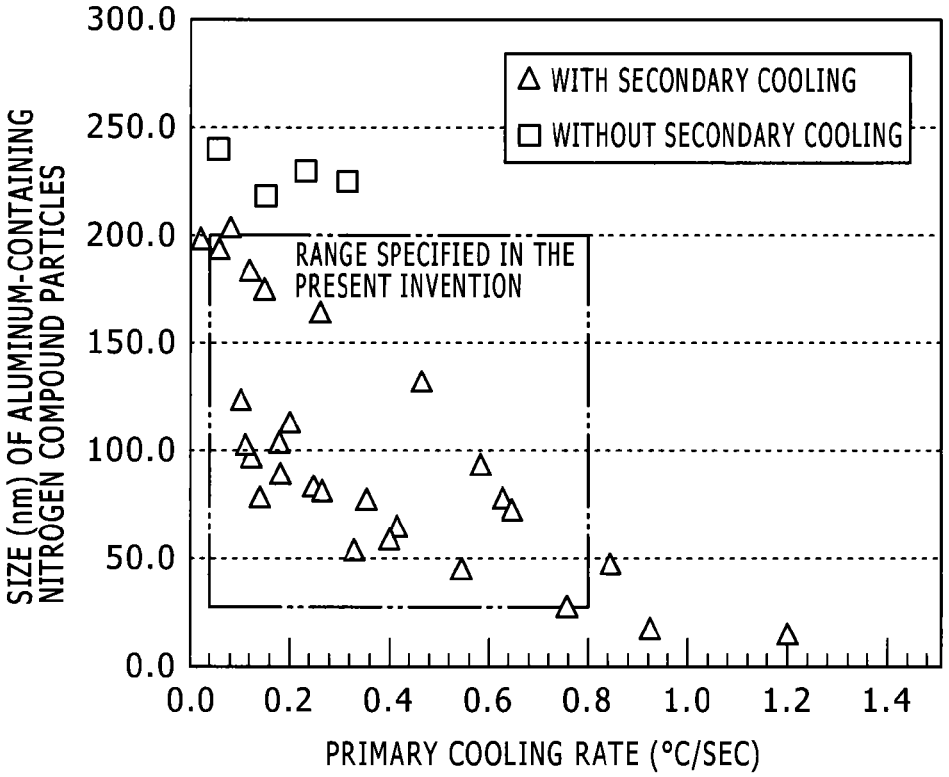
FIG. 4 is a graph illustrating how the size of Al-containing nitrogen compound particles varies depending on the primary cooling rate.

FIG. 3 illustrates how the fatigue life $L_{10}$ varies depending on the prior austenitic grain size number. FIG. 3 demonstrates that control of the prior austenitic grain site number within an appropriate range is effective to provide a long fatigue life $L_{10}$ (rolling-contact fatigue life). FIG. 4 illustrates how the size of Al-containing nitrogen compounds (average equivalent circle diameter of Al-containing nitrogen compound particles) varies depending on the primary cooling rate (average cooling rate). FIG. 4 demonstrates that control of the primary cooling rate within an appropriate range is effective to control the size of Al-containing nitrogen compound particles.

The invention claimed is:

1. A steel, comprising:

C in a content of from 0.65% to 1.30%;

Si in a content of from 0.05% to 1.00%;

Mn in a content of from 0.1% to 2.00%;

P in a content of from greater than 0% to 0.050%;

S in a content of from greater than 0% to 0.050%;

Cr in a content of from 0.15% to 2.00%;

Al in a content of from 0.010% to 0.042%;

N in a content of from greater than 0% to 0.025%;

Ti in a content of from greater than 0% to 0.015%; and

O in a content of from greater than 0% to 0.0025%, in mass percent, with the balance consisting of iron and inevitable impurities, wherein Al-containing nitrogen compound particles dispersed in the steel have an average equivalent circle diameter of from 25 to 200 nm, and wherein Al-containing nitrogen compound particles each having an equivalent circle diameter of from 25 to 200 nm are present in a number density of from 1.1 to 6.0 per square micrometer.

2. The steel of claim 1, wherein the steel has an average prior austenitic grain size number of 11.5 or less.

3. The steel of claim 1, further comprising at least one element selected from the group consisting of:

Cu in a content of from greater than 0% to 0.25%;

Ni in a content of from greater than 0% to 0.25%; and

Mo in a content of from greater than 0% to 0.25%.

4. The steel of claim 1, further comprising at least one element selected from the group consisting of:

Nb in a content of from greater than 0% to 0.5%;

V in a content of from greater than 0% to 0.5%; and

B in a content of from greater than 0% to 0.005%.

5. The steel of claim 1, further comprising at least one element selected from the group consisting of:

Ca in a content of from greater than 0% to 0.05%;

REM or REMs in a content of from greater than 0% to 0.05%;

Mg in a content of from greater than 0% to 0.02%;

Li in a content of from greater than 0% to 0.02%; and

Zr in a content of from greater than 0% to 0.2%.

6. The steel of claim 1, further comprising at least one element selected from the group consisting of:

Pb in a content of from greater than 0% to 0.5%;

Bi in a content of from greater than 0% to 0.5%; and

Te in a content of from greater than 0% to 0.1%.

7. The steel of claim 1, comprising C in a content of from 0.95% to 1.30%.

8. The steel of claim 1, comprising Ti in a content of from greater than 0% to 0.0035%.

9. The steel of claim 1, comprising:

C in a content of from 0.95% to 1.30%; and

Ti in a content of from greater than 0% to 0.0035%.

* * * * *